United States Patent [19]

Johansson

[11] Patent Number: 4,824,032

[45] Date of Patent: Apr. 25, 1989

[54] METHOD AND AN ARRANGEMENT FOR MIXING A DRY MATERIAL WITH A LIQUID

[75] Inventor: Bengt Johansson, Ingelstad, Sweden

[73] Assignee: Fläkt AB, Nacka, Sweden

[21] Appl. No.: 109,040

[22] Filed: Oct. 16, 1987

[30] Foreign Application Priority Data

Oct. 20, 1986 [SE] Sweden ..... 8604468

[51] Int. Cl.[4] ..... B02B 1/00; B02C 13/00

[52] U.S. Cl. ..... 241/46 B; 241/101 B; 366/157; 366/182; 366/295

[58] Field of Search ..... 366/142, 297, 20, 76, 366/182, 30, 33, 38, 64, 65, 154–157, 167, 168, 292, 293, 172, 173, 295, 279; 241/46 B, 101 B

[56] References Cited

U.S. PATENT DOCUMENTS

| | | | |
|---|---|---|---|
| 2,890,039 | 6/1959 | Schmidt | 366/157 X |
| 3,175,807 | 3/1965 | Gouvela | 366/103 |
| 4,225,092 | 9/1980 | Matter et al. | 241/46 B |
| 4,438,885 | 3/1984 | Martin | 241/101 B |

*Primary Examiner*—Timothy F. Simone

*Attorney, Agent, or Firm*—Burns, Doane, Swecker & Mathis

[57] ABSTRACT

The invention relates to a method and an arrangement for mixing a dry or substantially dry powder material (2) with a liquid to form a slurry (4), while using a vessel (7) which contains the liquid and which is provided with agitating means (5), and in which the powder material (2) is charged to the liquid continuously or intermittently. The powder material (2) is charged to the liquid (9) via a pipe (8). The end (8*a*) of the pipe through which the powder material is discharged is located at a distance beneath the surface (9*a*) of the mixture.

33 Claims, 1 Drawing Sheet

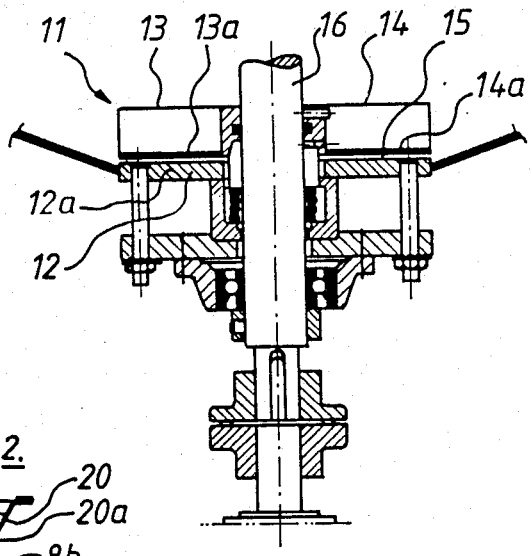
Fig. 2
Fig. 1
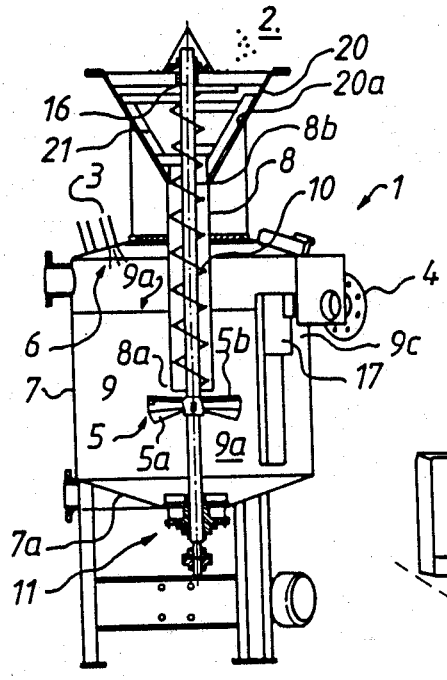
Fig. 3
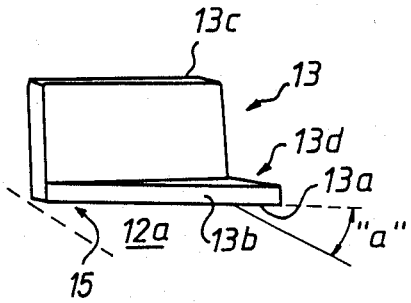

METHOD AND AN ARRANGEMENT FOR MIXING A DRY MATERIAL WITH A LIQUID

TECHNICAL FIELD

The present invention relates primarily to a method for mixing a dry, or a substantially dry powder material with a liquid to form a slurry.

To this end there is used in accordance with the invention a vessel which contains the liquid and which is provided with agitating or stirring means. The powder material is added to the liquid either continuously or intermittently. The present invention also relates to an arrangement for mixing a dry, or a substantially dry powder material with a liquid in order to form a slurry, the arrangement preferably being adapted to operate in accordance with the aforesaid method.

DESCRIPTION OF RELATED ART

Various methods and apparatus for mixing a dry or substantially dry powder material with a liquid so as to form a slurry are known to the art. These methods and arrangements are generally adapted to the nature of the powder material and the nature of the liquid used.

For example, it is previously known in connection with desulphurizing plants to form a slurry by mixing dust-generating powder with liquid, in the form of water, in a closed vessel, the powder being supplied over the surface of the liquid, which is stirred or agitated with the aid of rotating devices in the form of hooks or propeller-like devices, normally rotating about substantially vertical axes and with the hooks or propellers serving as motion generating means located beneath the surface of the liquid.

It is also known in this technical field to mix dust-generating powder with a liquid with the aid of paddle-like blades attached to horizontal shafts in open or closed vessels. The blades are normally arranged to move up and down, through the surface of the liquid. The powder is also here strewn across the surface.

It has been observed with both of the aforesaid embodiments that when slurry is taken out from the surface a proportion of undissolved powder accompanies the slurry, while when slurry is tapped from the bottom of the vessel it is accompanied by hard agglomerates or lumps.

In desulphurizing plants a slurry containing calcium hydroxide is charged to a contact reactor, where the slurry reacts with the sulphur-containing impurities. When this contact reactor is operated in accordance with the "wet-dry" method there is obtained from the reactor a residual dust which can be said to comprise a mixture of calcium sulphite, calcium sulphate, calcium hydroxide and fly ash.

Other arrangements and methods which form part of the present state of this art are those with which the residual dust, or recycle dust, removed from the reactor is recycled for re-use in the contact reactor, in which case there is taken from the contact reactor a dust in the form of a powder material which is mixed with a fresh absorbent, such as calcium hydroxide, and water to form a slurry.

When the fresh absorbent is dry slaked lime, the lime, recycle dust and water are mixed together to form a slurry having a dry solids content of about 35%. When the fresh absorbent added is wet slaked lime, this lime normally has a dry solids content of 20-25% and is mixed in the mixing vessel with recycle dust to a dry solids content of about 35%.

It is important to obtain a high dry solids content, since the energy losses in the desulphurizing system increase with the amount of water added thereto.

SUMMARY OF THE INVENTION

TECHNICAL PROBLEMS

When viewing the state of the prior art, and particularly when considering the technical difficulties that exist in mixing dry or substantially dry powder material taken from a contact reactor with a liquid, such as water, or with a slurry of fresh calcium hydroxide, it will be seen that a technical problem exists in the provision of conditions with which this mixture can be effected without creating excessively large lumps and deposits in the mixing vessel used.

It will also be seen when studying the present state of the art that a technical problem resides in the provision, with the aid of simple means, of conditions, which will enable dry material to be mixed with a liquid in a mixing vessel provided with agitating or stirring means without generating a dusty atmosphere.

A further technical problem in this regard is one of providing ways and means whereby any lumps or deposits that do form in the mixing vessel, in spite of measures taken to the contrary, are disintegrated or ground to pieces which will accompany the slurry.

Another technical problem is one of providing ways and means whereby lumps and deposits that form in the mixing vessel can be disintegrated into small particles of a size which will not block the nozzles of the contact reactor.

A qualified technical problem which prevails particularly in the aforesaid technical application resides in the provision of a method and arrangement for mixing a dry or substantially dry powder material obtained from a contact reactor with water which will prevent deposits on walls and shafts of the agitator means used from being given the opportunity to harden and loosen therefrom in lump form.

A further technical problem is one of providing with the aid of simple means conditions which will enable mixing to be effected in a manner to reduce and to eliminate aggregation of unmixed dry material, such dry material normally floating in the mixing vessel in dry lump form.

Another technical problem is one of providing, with the aid of simple means, when mixing the slurry material conditions which will enable the slurry to be tapped from the upper surface of the slurry bath without needing to risk floating dust agglomerates or lumps accompanying the agglomerates or lumps.

Finally, a further technical problem resides in the creation of conditions in the mixing vessel for the provision of milling means which will move excessively large lumps to one side and crush smaller lumps, and with which movement of the large lumps to one side is effected in a manner such that these large lumps are ground down and crushed into smaller lumps.

Another technical problem is one of providing, with the aid of simple means, conditions such that the milling means will also assist in mixing the dry powder with the water.

SOLUTION

The present invention provides a solution to one or more of the aforesaid technical problems, and primarily provides a method by means of which a dry or substantially dry powder material, particularly dry material taken from a contact reactor or calcium hydroxide can be mixed with a liquid in the form of water to form a slurry while using a vessel which encloses the liquid and which is provided with agitating or stirring means, and in which the powder material is supplied to the liquid either continuously or intermittently.

It is proposed in accordance with the invention that the powder material is discharged to the liquid via a pipe or tube and that the exit end of the pipe through which the powder material is discharged therefrom is located beneath the surface of the mixture.

It is also proposed in accordance with the invention that the powder material is caused to pass through the pipe with the aid of mechanical auxiliary devices and that when the powder material leaves the exit end of the pipe the material is brought into contact with agitator means, preferably in the form of a rotating propeller-like device. The powder material can be conveyed through the pipe by a screw conveyor arranged therein.

Heavy lumps which form in the vessel or at some other location are crushed by a milling means arranged at the bottom of the vessel, thereby enabling slurry formed in the vessel to be removed from the surface of the mixture or a location adjacent thereto.

It is also proposed that there is provided in the vessel a mixing zone which is separated from the outlet through which slurry formed in the vessel is discharged therefrom.

It has been found that the method can be used to particular advantage for slurrying the dry powder material obtained from waste products formed in a contact reactor intended for desulphurizing in accordance with the wet-dry method. Additionally, fresh lime in slurry form and water can be charged to the vessel, wherewith the water can be charged over the surface of the mixture to no disadvantage.

The method also related to an arrangement for mixing a dry or substantially dry powder material with a liquid to form a slurry while using a vessel which contains the liquid and which is provided with agitating or stirring means, and in which the powder material is supplied to the liquid continuously or intermittently, the arrangement being particularly adapted for operation in accordance with the aforesaid method.

It is proposed in this regard that a pipe or tube is arranged to co-act with the vessel in a manner such that one end of the pipe or tube is located beneath the surface of the mixture and that the powder material is moved through the pipe or tube and into the mixture with the aid of a mechanical auxiliary device.

This mechanical auxiliary device may comprise a conveyor, for example a screw conveyor.

Preferably, said one end of the pipe and the agitating means are located closely adjacent one another.

It is also proposed that the bottom of the vessel tapers downwardly and that a milling means is provided in the narrowest part of the vessel for crushing lumps which form in the vessel, or at some other location, and which have a density such as to cause the lumps to sink down in the mixture.

The milling means preferably comprises a plate having an irregular surface, for example a fluted circular plate, and rotatable vanes located above the plate, preferably at a distance of less than 2 mm therefrom. The vanes are obliquely positioned, such as to press small lumps against the plate.

A particular advantage is afforded when a screw conveyor, the aforesaid agitating means and the milling means are driven by one and the same drive shaft.

An outlet for removing the slurry mix from the vessel is arranged on or adjacent the surface of the mix, while arranged in the vessel, adjacent the outlet, is a screen means for separating the mixing zone in the vessel from the slurry outlet.

The pipe or tube through which the dry powder material is charged extends vertically or substantially vertically, with the screw conveyor filling the whole of the pipe interior. The other, upper end of the pipe or tube co-acts with a funnel shaped filling device, which includes one or more scraper bars capable of being moved along the inner surface of said device. The scraper bars may also be driven advantageously by the aforesaid shaft.

The agitating means is preferably arranged to move the mixture downwardly towards the milling means, and the milling means is provided with vanes of L-shaped cross-section, with the horizontally extending part of said vanes narrowing from the centre of rotation.

ADVANTAGES

Those advantages primarily afforded by a method and an arrangement according to the present invention reside in the provision of conditions whereby a dry or substantially dry powder material can be mixed with a liquid without creating a dust laden atmosphere and whereby the material and liquid can be mixed effectively without forming lumps and coatings of dried material on the walls of the vessels or on other components in the vessel.

BRIEF DESCRIPTION OF THE DRAWINGS

An embodiment at present preferred and exhibiting the characteristic features significant of the present invention will now be described in more detail with reference to the accompanying drawings, in which FIG. 1 is a side view, partly in section, of an arrangement constructed in accordance with the invention, FIG. 2 is a side view, in section and in a somewhat larger scale than FIG. 1, of a milling means located in the lower part of a liquid-containing vessel and;

FIG. 3 is a perspective view of the positioning of a vane used in the milling means.

DESCRIPTION OF AN EMBODIMENT OF THE PRESENT PREFERRED

The present invention thus relates to an arrangement 1 intended for mixing a dry or substantially dry powder material 2, in the form of calcium sulphite, calcium sulphate, calcium hydroxide and fly ash with a liquid, in the form of water, charged through a pipe 3 such as to form a slurry which can be removed through an outlet 4, while using a vessel 7 which is provided with agitating or stirring means 5 and which contains the liquid 6 introduced thereinto through the pipe 3 and in which the powder material 2 is intended to be charged into the liquid, either continuously or intermittently.

The arrangement is particularly adapted for operation in accordance with the method significant of the invention and in the aforesaid application.

In accordance with the invention a pipe 8 having a diameter of 150 cm is arranged to co-act with the vessel 7 in a manner such that one end of the pipe 8 is located at a depth of ca 500 mm beneath the surface 9*a* of the mixture 9 and that the powder material 2 is passed through the pipe 8 and into a mixing zone 9*b* with the aid of a mechanical auxiliary device.

The mechanical auxiliary device comprises a conveyor, for example a screw conveyor 10, which fills the whole of the interior of the pipe 8.

It is proposed in accordance with the invention that the said one end 8*a* of the pipe and the agitating means 5 are located closely adjacent one another, for instance at a distance apart of less than 50 mm, preferably less than 25 mm.

According to the invention the bottom 7*a* of the vessel 7 tapers downwardly adjacent the mixing zone 9*b*, such as to co-act with a milling means 11 which is arranged in the narrowest, lowermost part of the vessel and which is intended to crush small lumps formed in the vessel 7 or at some other location, particularly agglomerates or lumps whose density exceeds the density of the mixture 9, or such lumps as those which are urged downwardly by the agitating means 5.

FIG. 2 is an enlarged view of the milling means 11 illustrated in FIG. 1, and it will be seen from FIG. 2 that the milling means comprises a circular, lower plate 12 having an irregular or fluted upper surface 12*a* and diametrically positioned, rotatable vanes 13 and 14 spaced at a small distance above the plate 12.

The construction of the vane 13 will be described with reference to FIG. 3.

Located between the bottom edge surfaces 13*a* and 14*a* of the vanes 13 and 14 and the upper surface 12*a* of the plate 12 is a space 15 which is adapted to correspond to the maximum permitted particle size of the powder material. This distance shall therefore be less than 2 mm.

The vanes 13 and 14 are positioned obliquely and directed in the rotational direction, so as to be able to press and crush small lumps against the upper surface 12*a* of the plate 12.

It will also be seen that the screw conveyor 8, the agitating means 5, and the vanes 13, 14 of the milling means are driven by one and the same drive shaft 16, which rotates, for example, at 150 rpm.

The slurry mix 9*c* is removed from the vessel through an outlet 4 located at or adjacent the surface 9*a* of the mix.

Arranged in the vessel 7 adjacent the outlet 4 is a screen 17 which separates the mixing zone 9*b* in the vessel 7 from the slurry outlet 4.

As shown in FIG. 1, the pipe 8 extends vertically, although there is nothing to prevent the pipe from being slightly inclined with the screw conveyor 7 filling the interior of the pipe.

The other end 8*b* of the pipe co-acts with a funnel-shaped filling device 20, which includes one or more scraper bars 21 capable of being moved along the inner surface 20*a* of the filling device. The scraper bars 21 are attached to the shaft 16 via support means, such as to be driven by said shaft.

The agitating means 5 comprises two vanes, referenced 5*a* and 5*b*, which are located essentially in the center of the vessel or centrally of the mix 9.

The milling means is provided with two vanes, referenced 13 and 14, which are inclined slightly to the vertical plane.

The angle at which the vanes are included is such as to ensure that a lump entering between the leading part of the vane and the bottom edge 13*a* thereof will be crushed to pieces against the surface 12*a*.

The pipe end 8*a* is preferably located beneath the surface 9*a* at a distance greater than 30 cm, but preferably not greater than half the depth of the mix.

The agitating means preferably has a diameter such as to cover at least 25% of the diameter of the vessel, but not more than 50%.

The screen 17 is arranged to extend beyond the agitating means 5 on the side thereof where it meets the rotation created by the agitating means, but is much shorter on the downstream side.

The screen does not extend sealingly against the wall in the vessel. A gap of 10–20 mm affords a certain amount of rotation behind the screen such as to prevent the formation of deposits or coatings deriving from stationary slurry 9*c*.

The relationship between the flows of material entering the mixing vessel is determined by taking density measurements in the outlet 4 or in a subsequent storage tank, not shown.

The amount of powderous material charged is controlled through metering means (not shown) located above the funnel 20.

The powder material is charged in a quantity such that it only fills a small part of the cross-section of the pipe 8, so that there is effected within the lower part 8*a* of the pipe an initial mixing of dry powder with a previous mixture in the mixing zone 9*b*, with the aid of the end part of the screw conveyor, whereafter mixing is effected with the aid of the agitating means 5, which steers the mixture down towards the milling means 11.

This initial mixing process takes place partially in a vertical direction within a limited space within the pipe end 8*a*, therewith preventing the emission of dust.

A vane 13 forming part of the milling means 11 is illustrated in FIG. 3.

The vane consists of L-shaped angle iron which is slightly inclined so that lower bottom surface 13*a* of the lower part 13*d* forms a wedge-shaped space with the surface 12*a*. This wedge-shaped space may have an angle "a" of less than 20°, preferably less than 10°.

This means that small lumps are pressed into the wedge-shaped space and crushed into particles of such small size as to enable them to be used in the final slurry.

Larger lumps are pressed outwardly by an oblique surface 13*b* and glide over the surface 12*a* and against one another so as to be ground down autogenously. The vessel wall serves to move lumps back towards the surface 12*a*, so as to be fed away by the next vane. The large lumps are ground down in this way to smaller lumps which can be crushed in the milling means.

The upper part 13*c* is intended to push large lumps in its forward direction, but also contributes towards improving the mixture.

It will be understood that the invention is not restricted to the aforedescribed exemplifying embodiment thereof, and that modifications can be made within the scope of the invention defined in the following claims.

I claim:

1. A method for mixing a dry or substantially dry powder material with a liquid to form a slurry mixture having a surface in a vessel which contains the liquid and which is provided with agitating or stirring means, comprising the steps of:

continuously or intermittently discharging the powder material into the liquid at a distance beneath the surface of the liquid via a pipe, the discharging end of the pipe through which the powder material is discharged is positioned at a distance beneath the surface of the mixture; and crushing lumps in the mixture in a milling means arranged at the bottom of the vessel.

2. A method according to claim 1, further comprising the step of passing the powder material through the pipe with the aid of a mechanical auxiliary device.

3. A method according to claim 2, further comprising the step of bringing the powder material leaving said pipe end into contact with the agitating means which is in the form of a rotating propeller-like device.

4. A method according to claim 2, further comprising the step of transporting the powder material through the pipe by means of a screw conveyor arranged in said pipe.

5. A method according to claim 1, further comprising the step of bringing the powder material leaving said pipe end into contact with the agitating means, which is in the form of a rotating propeller-like device.

6. A method according to claim 5, further comprising the step of transporting the powder material through the pipe by means of a screw conveyor arranged in said pipe.

7. A method according to claim 1, further comprising the step of transporting the powder material through the pipe by means of a screw conveyor arranged in said pipe.

8. A method according to claim 1, further comprising the step of removing the formed slurry form the surface of the mixture or a location adjacent to said surface.

9. A method according to claim 8, further comprising the step of screening finally mixed slurry in the vessel from slurry that is being mixed.

10. A method according to claim 1, further comprising the step of selecting the dry powder material from waste products obtained from a contact reactor.

11. A method according to claim 10, further comprising the step of discharging water and fresh lime in slurry form to the vessel.

12. A method according to claim 11, further comprising the step of discharging the fresh lime in slurry form and the water over the surface of the mixture.

13. An arrangement for mixing a dry or substantially dry powder material with a liquid to form a slurry mixture having a surface, comprising:

a vessel for containing the liquid;

agitating means in the vessel;

a pipe arranged to so co-act with the vessel that one end of the pipe is located beneath the surface of the mixture;

a mechanical auxiliary device provided for passing the powder material through the pipe and into the mixture at a location adjacent the agitating means; and milling means disposed at the bottom of the vessel for crushing lumps in the mixture.

14. An arrangement according to claim 13 wherein the mechanical auxiliary device is a screw conveyor.

15. An arrangement according to claim 14, further comprising a single shaft for driving the screw conveyor, the agitating means and the milling means.

16. An arrangement according to claim 15, wherein the pipe extends vertically or substantially vertically, with the screw conveyor filling the interior of the pipe.

17. An arrangement according to claim 16, further comprising a funnel-shaped filling device that coacts with an upper end of the pipe.

18. An arrangement according to claim 13, wherein the funnel shaped filling device comprises one or more scraper bars which are moveable along an inner surface of said device.

19. An arrangement according to claim 18, wherein the scraper bars are driven by said shaft.

20. An arrangement according to claim 14, wherein the one end of the pipe and the agitating means are arranged closely adjacent one another.

21. An arrangement according to claim 13, wherein the one end of the pipe and the agitating means are arranged closely adjacent one another.

22. An arrangement according to claim 13, wherein the bottom of the vessel narrows downwardly; and the milling means for crushing lumps is provided in the narrowest part of the vessel.

23. An arrangement according to claim 22, further comprising a single shaft for driving the screw conveyor, the agitating means and the milling means.

24. An arrangement according to claim 22, wherein the milling means comprises a plate having an irregular surface, and rotatable vanes are located above the plate.

25. An arrangement according to claim 24, wherein the vanes have an L-shaped cross-section including a horizontally direction part which narrows from the center of rotation.

26. The arrangement according to claim 24, wherein the plate is a fluted plate.

27. An arrangement according to claim 24, wherein the vanes are positioned and directed in a manner to press small lumps against the plate.

28. An arrangement according to claim 27, wherein the vanes have an L-shaped crosssection including a horizontally direction part which narrows from the center of rotation.

29. The arrangement according to claim 27, wherein the plate is a fluted plate.

30. An arrangement according to claim 13, further comprising outlet means for removing finally mixed slurry, said outlet means being located at or adjacent to he surface of the mixture.

31. An arrangement according to claim 30, further comprising a screen for separating a mixing zone in the vessel from finally mixed slurry arranged adjacent the outlet means in said vessel.

32. An arrangement according to claim 30, further comprising a screen for separating a mixing zone in the vessel from finally mixed slurry arranged adjacent the outlet means in said vessel.

33. An arrangement according to claim 13, wherein the agitating means is arranged to impart a downward movement in the mixture.

* * * * *